US006384726B1

(12) United States Patent
Epple et al.

(10) Patent No.: US 6,384,726 B1
(45) Date of Patent: May 7, 2002

(54) AUTOMATIC POOL COVER SAFETY SYSTEM

(75) Inventors: Thomas A. Epple; Timothy M. Saxer, both of Fort Wayne, IN (US)

(73) Assignee: Fort Wayne Pools, Inc., Fort Wayne, IN (US)

( * ) Notice: Subject to any disclaimer, the term of this patent is extended or adjusted under 35 U.S.C. 154(b) by 0 days.

(21) Appl. No.: 09/703,910

(22) Filed: Nov. 1, 2000

(51) Int. Cl.[7] ..... G08B 13/18

(52) U.S. Cl. ..... 340/567; 340/545.6; 340/573.6; 4/502

(58) Field of Search ..... 340/567, 573.1, 340/573.6, 545.1, 545.5, 545.6, 547.8; 4/502, 504

(56) References Cited

U.S. PATENT DOCUMENTS 3,813,704 A * 6/1974 Troiano ..... 4/172.13
4,116,745 A * 9/1978 Lamgert ..... 156/362
4,459,711 A * 7/1984 Sartain et al. ..... 4/502
4,483,025 A * 11/1984 Meredith ..... 4/510
4,910,498 A 3/1990 Feher ..... 340/556
5,023,593 A 6/1991 Brox ..... 340/522
5,067,184 A 11/1991 Last ..... 4/502
5,184,356 A * 2/1993 Lof et al. ..... 4/502
5,357,183 A * 10/1994 Lin ..... 318/468
5,524,302 A * 6/1996 Ragsdale et al. ..... 4/502
5,883,579 A * 3/1999 Schreiner et al. ..... 340/686
6,127,930 A * 10/2000 Steffanus ..... 340/573.1

* cited by examiner

*Primary Examiner*—Daniel J. Wu
*Assistant Examiner*—Phung T Nguyen
(74) *Attorney, Agent, or Firm*—Taylor & Aust, P.C.

(57) ABSTRACT

A safety system for an automatic swimming pool cover having a cover and a cover drive for extending and retracting the cover, the safety system having at least one sensor for detecting the presence of a heat generating body in the pool and for generating a signal in response thereto; and a controller receiving said signal and activating a safety protocol in response to the at least one sensor detecting the presence of a heat generating body.

17 Claims, 3 Drawing Sheets

AUTOMATIC POOL COVER SAFETY SYSTEM

FIELD OF THE INVENTION

The present invention relates to swimming pools, and, more particularly, to a safety system for use with automatic pool covers, to guard against people or animals becoming trapped under the closed pool cover.

DESCRIPTION OF THE RELATED ART

Swimming pools are commonly covered to prevent debris from entering the pool, to reduce chemical usage and to heat the pool in the case of a solar cover. An automatic pool cover provides convenience for a user by allowing the cover to be easily extended over the pool during periods of non-use, and retracted during periods of use. Typically, the cover is wound around a reel retained within a cover box at one end of the pool, commonly the deep end, opposite from the walk-in steps. The box extends across the width of the pool, and houses an electric motor and the reel on which the cover is wound. An endless cable loop and a track are associated with a coping or wall of the pool, or the deck surrounding the pool. Side edges of the cover are carried by the track. A drive mechanism draws the cable around the track, extending the cover over, or retracting the cover from the pool. When in the extended, or closed, position over the pool, the cover hangs from the track and slopes away from the track, toward the middle of the pool. The center portion of the cover rests on the surface of the water in the pool. While some covers are manually covered, it is common to have operation of the cover powered by an electric motor.

A problem with conventional automatic pool covers is that, once activated for closing, the drive continues in operation until the pool is completely covered, unless the motor is deactivated, or a mechanical or electrical fault occurs. Thus, it is possible that a person, a pet or other animal that happens to be in the pool when the cover is activated for closing, could become trapped under the pool cover.

It is known to detect the presence of an individual or animal in a pool through the use of wave detector alarms activated by surface movement of the water. The wave detectors may be sensing apparatus mounted on the side of the pool, or floating apparatus in the pool water. It is also known to use perimeter alarms activated by someone or something interrupting a beam of light reflected around the pool perimeter. A sensing apparatus including a sensor mounted near the pool and a transmitter worn by swimmers is also known.

While the above may be useful in detecting an initial entry into the pool, if the initial warning is missed, many do not sense the continued presence of a person in the pool. Also, many are easily circumvented by a mischievous child. If an automatic pool cover is activated without first checking the pool, a person or animal could become trapped under the pool cover.

What is needed in the art is an automatic pool cover safety system which can warn swimmers that the pool cover is being closed. What is further needed is an automatic pool cover safety system which can detect the presence of a person in the pool, and issue a warning signal, or deactivate the closing procedure when a person or animal is detected in the pool.

SUMMARY OF THE INVENTION

The present invention provides a swimming pool including an automatic pool cover with a warning and safety system, which alerts occupants when the cover is activated, terminates cover closing if a person or pet is in the pool and issues an alarm.

The invention comprises, in one form thereof, a swimming pool comprising a wall defining an enclosed space and a target water level and a liner extending along the wall. A pair of tracks are associated with said side wall, and a cover includes a pair of longitudinal side edges, each carried by a corresponding track. A drive mechanism is operable for extending and retracting the cover; and a cover closing warning system is connected to the drive mechanism for alerting pool users when the cover is being closed.

The invention comprises, in another form thereof, a safety system for an automatic swimming pool cover having a cover and a cover drive for extending and retracting the cover, the safety system comprising at least one sensor for detecting the presence of a heat generating body in the pool and for generating a signal in response thereto; and a controller receiving said signal and activating a safety protocol in response to the at least one sensor detecting the presence of a heat generating body.

In yet another form, the invention comprises a swimming pool automatic cover system including a cover, a track carrying the cover, a drive mechanism for extending and retracting the cover; and an alarm activated by operation of the drive mechanism.

In still another form thereof, the invention comprises A swimming pool automatic cover system comprising, a cover, a track carrying the cover, a drive mechanism for extending and retracting the cover, a sensor for detecting the presence of a heat generating body and for generating a signal in response thereto, and a controller to receive the signal and deactivate the drive mechanism.

An advantage of the present invention is a warning signal to alert persons when an automatic pool cover is being closed.

Another advantage is the reduced possibility that persons or animals will become trapped under the closed pool cover.

Yet another advantage is a safety system for automatic pool covers which can be retrofit in existing installations in an efficient manner.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
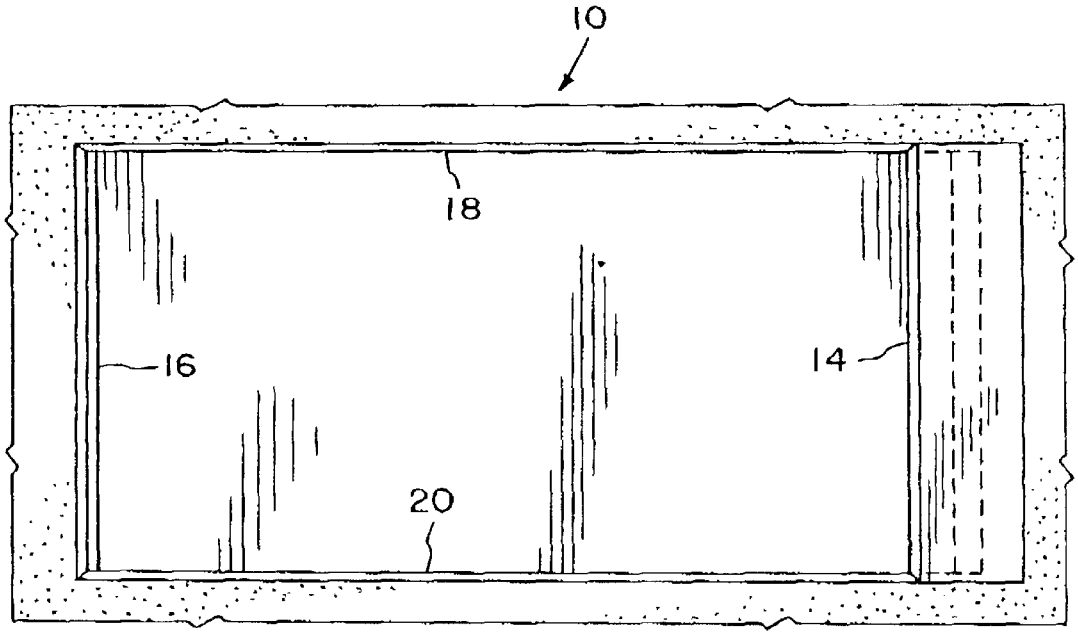
FIG. 1 is a plan view of a swimming pool having an automatic pool cover in a closed position.
Figure 2:
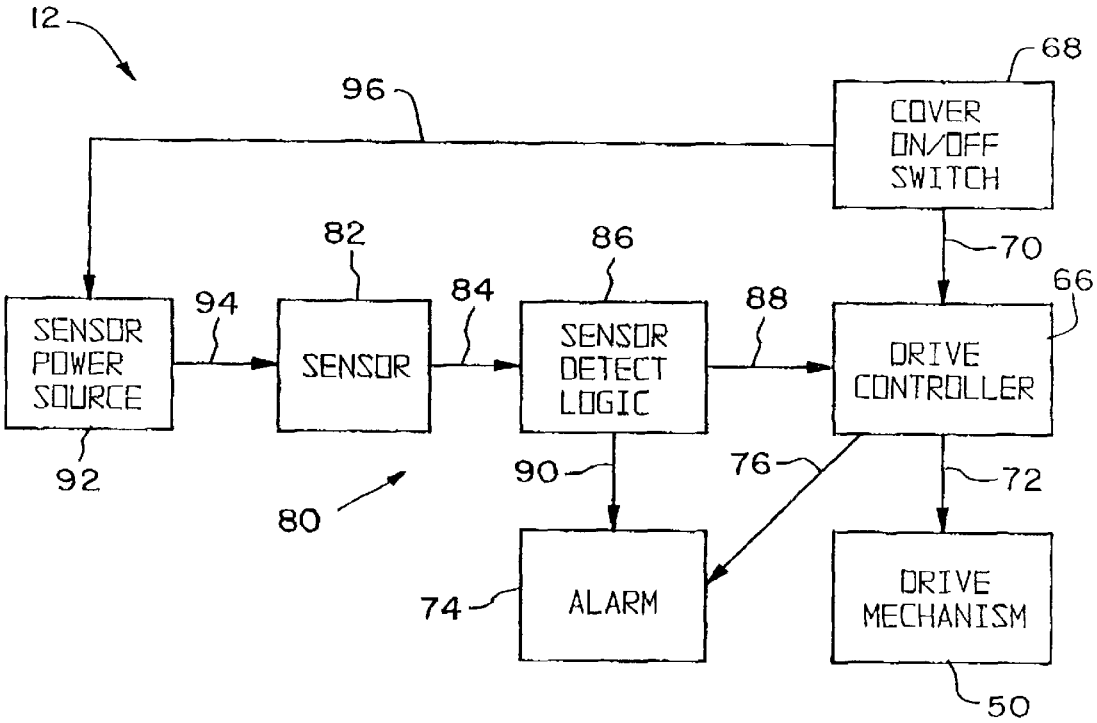
FIG. 2 is a schematic representation of an automatic pool cover safety system according to the present invention.

Referring now to the drawings, and more particularly to FIG. 1, there is shown an embodiment of a swimming pool 10, which includes an automatic pool cover safety system 12 of the present invention, shown more clearly in FIG. 2. It should be understood that pool 10, to be described hereinafter, is only an example of a pool structure in which the present invention may be used advantageously, and that a safety system according to the present invention may be used advantageously on other types, structures and styles of swimming pools.

Swimming pool 10 includes a wall defining an enclosed space, and in the embodiment shown, includes a pair of opposite end walls 14, 16 and a pair of opposite side walls 18, 20. End walls 14, 16 and side walls 18, 20 form an enclosed region for containing water of pool 10, and define a target water level 22 (FIG. 6) within swimming pool 10. To wit, end walls 14, 16 and/or side walls 18, 20 typically include one or more skimmers (not shown) and one or more water returns (not shown). It is usually desirable to fill swimming pool 10 to a specified degree for proper operation of the skimmers, etc. Of course, the actual water level may vary somewhat from target water level 22 and still provide effective operation of swimming pool 10.

Figure 6:
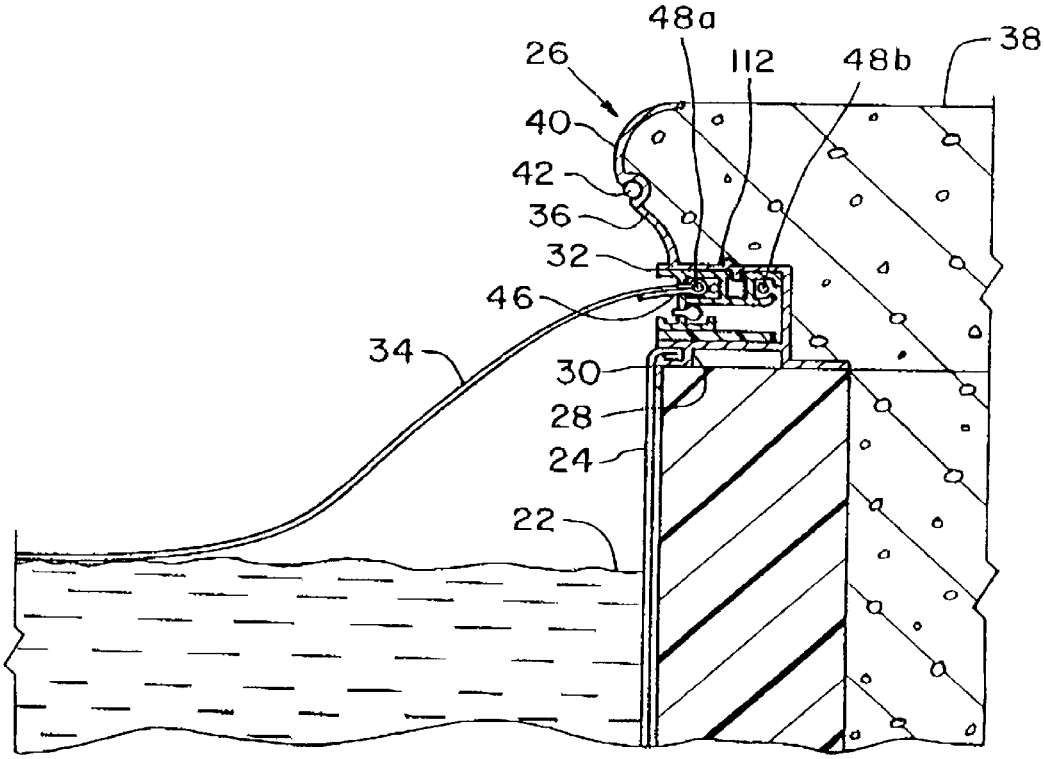
FIG. 6 is a cross-sectional view of a swimming pool side wall, showing another embodiment of the present invention.

End walls 14 and 16 and side walls 18 and 20 are constructed of metal, plastic, or the like. A vinyl liner 24 is provided as a watertight barrier along end walls 14, 16 and side walls 18, 20 and across the bottom of the pool. Each of side walls 18, 20 includes a side coping 26, which is fastened to side walls 18, 20. A single side coping 26 is illustrated in FIG. 6, for side wall 18. Opposite side wall 20 likewise includes a substantially identically configured side coping 26. A liner bead slot 28 is provided in each side coping 26, for carrying an edge bead 30 of vinyl liner 24, for holding liner 24 in proper position. Side coping 26 further includes a track 32, above target water level 22, for carrying a cover 34, as will be described in greater detail hereinafter. Side coping 26 defines a facial 36 extending along the top, side edges of swimming pool 10, and serves to join a top deck area 38, immediately outside of pool 10, to sidewall 18. Deck area 38 is commonly an area of poured concrete surrounding pool 10. A light receiving slot 40 and a fiber optic tube light 42 may be used with side coping 26, for aesthetic appearance. Individual lengths of side coping 26 are coupled in an end-to-end manner so that side coping 26 extends from one end of pool 10 to the other end of pool 10. Side coping 26 may be made of plastic, but preferably is of metal such as aluminum, and is formed by a process of extrusion. Liner 24 extends lengthwise in pool 10 from end wall 14 to end wall 16, and across pool 10 from side coping 26 on side wall 18 to side coping 26 on side wall 20, being secured in liner bead slots 28 thereof.

Cover 34 includes a pair of longitudinal side edges 44, 46 (FIG. 1). Each side edge 44, 46 is carried by a corresponding track 32 along respective side walls 18, 20 (FIG. 6). A rope carrier 48 is sewn into cover 34 along each side edge 44, 46. Rope carrier 48 is received within a corresponding track 32 for allowing cover 34 to be extended and retracted over pool 10. The term "rope carrier", as used herein, is intended to mean any elongate element which may be coupled with a corresponding side edge 44, 46 and carried within a corresponding track 32, such as, for example, nylon, hemp or steel rope. Rope carrier 48 extends the length of pool 10, in a continuous loop having a first leg 48*a* which carries cover 34, and a return leg 48*b*.

Figure 3:
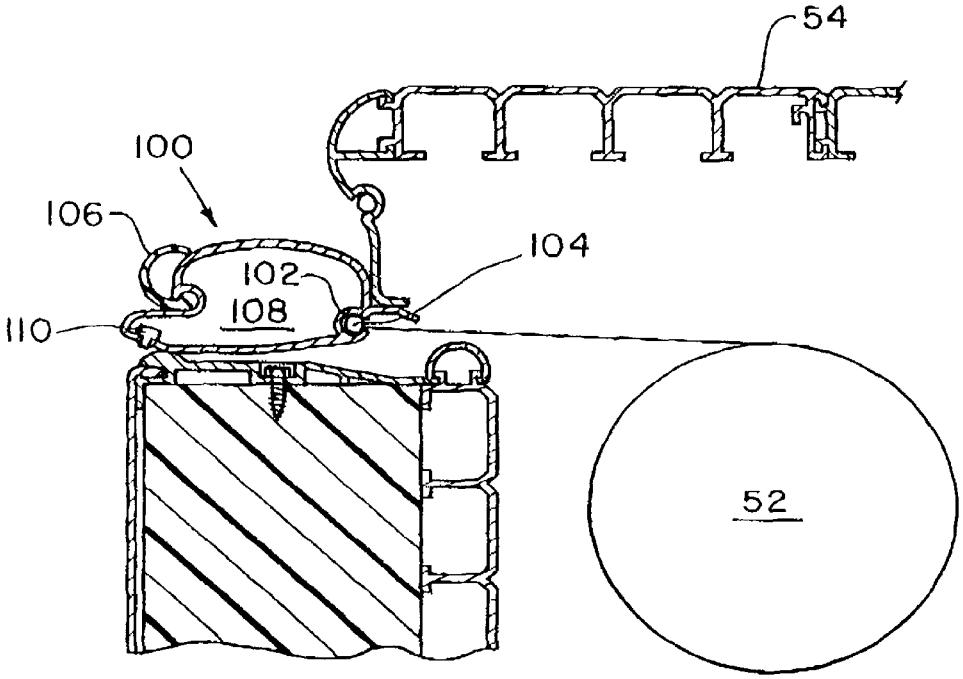
FIG. 3 is a cross-sectional view of a pool end wall and automatic pool cover, showing an embodiment of the present invention.

Cover 34 is an automatic cover, having drive mechanism 50 (FIG. 5) for extending and retracting cover 34 over the water in pool 10. As shown in FIG. 3, cover 34 is stored on a reel 52 in a cover box 54 disposed at one end of pool 10. In FIG. 3, cover box 54 is shown positioned immediately outwardly of end wall 14, and may be constructed of treated lumber or may be a modular structure of extruded thermoplastic, aluminum, or the like.

Drive mechanism 50 includes a motor 56 connected by a shaft 58, or similar driving connection, to a gear reducer 60. A second shaft 62, or similar driving connection, connects gear reducer 60 to a drum 64 on which several round of rope carrier 48 may be wound. Drum 64 may be a part of reel 52, or may be connected to reel 52, such that drive mechanism 50 also turns reel 52. Drive mechanism 50 is activated by a drive controller 66 initiated by an on/off switch 68. Signal pathways 70 and 72 connect on/off switch 68 to drive controller 66, and drive controller 66 to motor 56, respectively.

In accordance with one aspect of the present invention, an alarm 74 is provided, and connected to and controlled by drive controller 66. Upon activation of drive controller 66, a signal is sent via a signal pathway 76 to initiate an audible warning from alarm 74. Signal pathway 76 may be an electrical pathway, or as those skilled in the art will understand, controller 66 may include a radio frequency transmitter, and alarm 74 may include a radio frequency receiver, for transmission and reception of a radio frequency signal. The warning issued from alarm 74 may consist of a continuous tone or siren, a series of beeps or the like, sufficient to attract the attention of persons in or around pool 10, indicating to them that cover 34 is being moved.

In accordance with another aspect of the present invention, shown in FIG. 2, safety system 12 includes a sensor system 80 for detecting the presence of heat generating bodies, such as people, pets or other animals, that may be in pool 10 when cover 34 is being extended over pool 10. A sensor 82, or a series of sensors 82 are provided for detecting the presence of heat generating bodies in pool 10 and generating a signal in response thereto. The signal from sensor 82 is transmitted via a signal pathway 84 to sensor detection and processing logic unit 86. Upon the determination of a heat generating body being present in pool 10, a signal is generated by logic unit 86, and transmitted via a signal pathway 88 to drive controller 66. Simultaneously, a signal from logic unit 86 is transmitted via a signal pathway 90 to alarm 74. In response thereto, alarm 74 issues a warning different from the warning for the indication of cover closing. Upon the detection of a heat generating body in pool 10, the warning should be of a more urgent character, perhaps of greater volume, higher pitch, at shorter intervals, etc. In addition to initiation of a warning signal, upon the detection of a heat generating body the signal transmitted to drive controller 66 causes drive controller 66 to initiate a safety protocol therein, which may include interrupting operation of drive mechanism 50 by terminating the drive signal thereto.

Sensor 82 is operated by power from a power source 92 via a power connection 94. Power source 92 can be storage batteries, a connection to household electrical current, or, advantageously, a solar collector power source. Transmission of power from power source 92 to sensor 82 is initiated by a signal from on/off switch 68 via a signal pathway 96. Thus, sensor 82 and sensor system 80 are functional only upon initiation of a cover movement procedure, and will not give errant warnings during normal use of pool 10. Advantageously, activation of sensor 82 occurs only upon initiation of a cover closing procedure, as operation during a cover retraction procedure would not achieve significant advantage. However, issuing a warning signal from alarm 74 during either a cover closing procedure, or a cover retraction procedure would be advantageous in alerting individuals that cover 34 is being moved.

Sensor 82 should be a sensor capable of distinguishing a living being from an inanimate object. Self-contained infrared sensors capable of detecting heat generating bodies are suitable, and will detect the presence of a person or animal. To ensure that a person or animal is not trapped under cover 34, it is necessary that the entire area confined by walls 14, 16, 18 and 20 be scanned by sensor system 80.

Cover 34 frequently includes a leading edge bar 100, one such leading edge bar 100 being illustrated in FIG. 3. Leading edge bar 100 is attached to the leading edge of cover 34, and extends across pool 10. Leading edge bar 100 may simply be a rod or tube slipped on or sewn into the fabric of cover 34. However, to minimize deflection of the leading edge bar 100 a more substantial structure can be used, as shown in FIG. 3. Leading edge bar 100 is a hollow body slidingly carried on opposite ends thereof in tracks 32, and may be of a variety of profiles including high and low profiles. A rear slot 102 carries a front bead 104 of cover 34, to secure leading edge bar 100 to cover 34. At the front of leading edge bar 100, a bumper 106 is provided.

Figure 4:
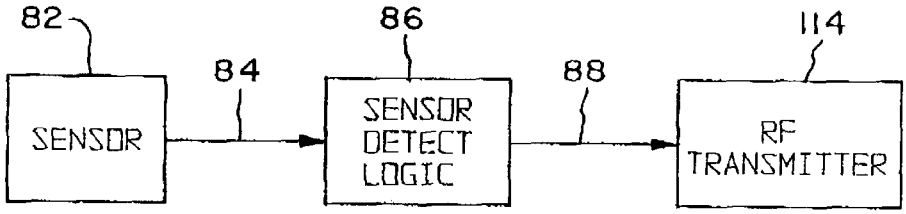
FIG. 4 is a schematic representation of a sensor system in the present invention.
Figure 5:
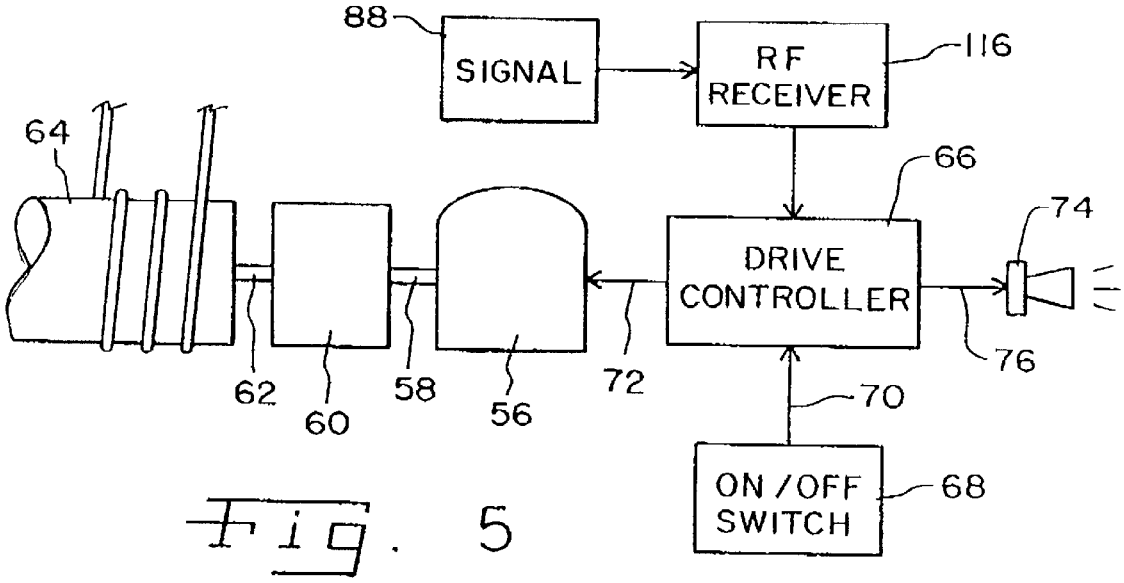
FIG. 5 is a schematic representation of an automatic pool cover drive system including the present invention.

Within a hollow space 108, a series of infrared sensors 110 are disposed along the length of leading edge bar 100. Each such sensor 110 scans a divergent area outwardly and downwardly of leading edge bar 100, and as leading edge bar 100 moves from its retracted position to its extended position at which the pool is covered, sensors 110 scan the entire volume of the pool confined within walls 14, 16, 18 and 20. Each sensor 110 is connected to a sensor detection and logic unit 86, which also may be disposed within hallow space 108. Signal pathway 88 from logic unit 86 to drive controller 66 may be an electrical signal pathway such as a wire or cable 112 disposed along track 32 with rope carrier leg 48*a*. Alternatively, signal pathway 88 may include a radio frequency transmitter 114 (FIG. 4) communicating with a radio frequency receiver 116 (FIG. 5). If power source 92 and radio frequency transmitter 114 are also provided in leading edge bar 100, retrofit of existing automatic pool covers will be facilitated, in that an existing leading edge bar can be replaced with a leading edge bar 100 containing the necessary components including power source 92 sensors 82, logic unit 86 and transmitter 114. The remaining components, including radio frequency receiver 116 and alarm 74 can be installed in and around more easily accessible areas, such as cover box 54.

An alternative location for infrared sensors 110 is shown in FIG. 6, wherein a plurality of sensors 110 are disposed in side coping 26. Each such sensor 110 may be connected to a wire or cable 112 connected to logic unit 86, or one or several infrared sensor 110 may be connected to one or more radio frequency transmitters 114 as described above.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A swimming pool, comprising:

a wall defining an enclosed space and a target water level;

a liner extending along said wall;

a coping associated with said side wall and positioned above said target water level, said coping including means for retaining an edge of said liner;

a pair of tracks associated with said side wall;

a swimming pool cover including a pair of longitudinal side edges, each said side edge of said cover carried by a corresponding said track;

a drive mechanism operable for extending and retracting said swimming pool cover; and a swimming pool cover closing warning system connected to said drive mechanism for alerting pool users when said swimming pool cover is being closed.

2. The swimming pool of claim 1, said warning system including an audible sound emitting device activated upon said cover moving between closed and opened positions.

3. A swimming pool comprising:

a wall defining an enclosed space and a target water level;

a liner extending along said wall;

a coping associated with said side wall and positioned above said target water level, said coping including means for retaining an edge of said liner;

a pair of tracks associated with said side wall;

a cover including a pair of longitudinal side edges, each said side edge of said cover carried by a corresponding said track;

a drive mechanism operable for extending and retracting said cover; and a cover closing warning system connected to said drive mechanism for alerting pool users when the cover is being closed, said warning system including an audible sound emitting device activated upon said cover moving between closed and opened positions, and including a sensor for detecting the presence of a heat generating body in said pool and for generating a signal in response thereto.

4. The swimming pool of claim 3, including a leading edge bar associated with said cover and sensors disposed in said leading edge bar for detecting the presence of heat generating body in said pool and for generating a signal in response thereto.

5. The swimming pool of claim 4, including a radio frequency transmitter associated with said sensors.

6. A swimming pool comprising:

a wall defining an enclosed space and a target water level;

a liner extending along said wall;

a coping associated with said side wall and positioned above said target water level, said coping including means for retaining an edge of said liner;

a pair of tracks associated with said side wall;

a cover including a pair of longitudinal side edges, each said side edge of said cover carried by a corresponding said track;

a drive mechanism operable for extending and retracting said cover; and a cover closing warning system connected to said drive mechanism for alerting pool users when the cover is being closed, including a sensor associated with said wall, for detecting the presence of a heat generating body in said pool and for generating a signal in response thereto.

7. The swimming pool of claim 6, including a radio frequency transmitter associated with said sensor.

8. The swimming pool of claim 6, said warning system including an audible sound emitting device activated upon said cover moving between closed and opened positions.

9. A swimming pool comprising:

a wall defining an enclosed space and a target water level;

a liner extending along said wall;

a coping associated with said side wall and positioned above said target water level said coping including means for retaining an edge of said liner;

a pair of tracks associated with said side wall;

a cover including a pair of longitudinal side edges, each said side edge of said cover carried by a corresponding said track;

a drive mechanism operable for extending and retracting said cover; and a cover closing warning system connected to said drive mechanism for alerting pool users when the cover is being closed, including a leading edge bar associated with said cover and sensors disposed in said leading edge bar for detecting the presence of a heat generating body in said pool and for generating a signal in response thereto.

10. The swimming pool of claim 9, including a radio frequency transmitter associated with said sensors.

11. A safety system for an automatic swimming pool cover having a cover and a cover drive for extending and retracting the cover, said safety system comprising;

a drive controller controlling operation of the cover drive;

at least one sensor for detecting the presence of a heat generating body in the pool and for generating a signal in response thereto; and said controller receiving said signal and activating a safety protocol in response to said at least one sensor detecting the presence of a heat generating body;

said sensor being operationally integrated with said drive controller and being initiated upon said drive controller initiating the cover drive.

12. The safety system of claim 11, said controller being connected to the cover drive and including interrupt means for terminating operation of the cover drive when said at least one sensor detects the presence of a heat generating body.

13. The safety system of claim 12, including an alarm operable by said controller.

14. The safety system of claim 11, including an alarm operable by said controller.

15. A swimming pool automatic cover system comprising a swimming pool cover;

a track carrying said swimming pool cover;

a drive mechanism for extending and retracting said swimming pool cover; and an alarm activated by operation of said drive mechanism.

16. A swimming pool automatic cover system comprising, a cover;

a track carrying said cover;

a drive mechanism for extending and retracting said cover; and an alarm activated by operation of said drive mechanism, including a sensor for detecting the presence of a heat generating body and for generating a signal in response thereto, and a controller for receiving said signal and activating said alarm.

17. A swimming pool automatic cover system comprising, a cover;

a track carrying said cover;

a drive mechanism for extending and retracting said cover;

a sensor for detecting the presence of a heat generating body and for generating a signal in response thereto; and a controller to receive said signal and deactivate said drive mechanism.

* * * * *